US010149561B2

(12) United States Patent
Kim

(10) Patent No.: US 10,149,561 B2
(45) Date of Patent: Dec. 11, 2018

(54) MULTI-WALLED GLASS CONTAINER WITH FREEZABLE SUBSTANCE AND SAFETY PLUG

(71) Applicant: RK GLASSWARE, INC., La Mirada, CA (US)

(72) Inventor: Robert Kim, La Mirada, CA (US)

( * ) Notice: Subject to any disclaimer, the term of this patent is extended or adjusted under 35 U.S.C. 154(b) by 218 days.

(21) Appl. No.: 14/942,078

(22) Filed: Nov. 16, 2015

(65) Prior Publication Data

US 2016/0135628 A1 May 19, 2016

Related U.S. Application Data

(60) Provisional application No. 62/080,388, filed on Nov. 16, 2014.

(51) Int. Cl.
*A47G 19/22* (2006.01)

(52) U.S. Cl.
CPC ..... *A47G 19/2288* (2013.01)

(58) Field of Classification Search
CPC ..... A47G 19/2288; F25D 2331/808; F25D 2303/0831; F25D 3/08
See application file for complete search history.

(56) References Cited

U.S. PATENT DOCUMENTS

| | | | | |
|---|---|---|---|---|
| 4,485,636 | A | 12/1984 | Hilado | |
| 5,573,141 | A | 11/1996 | Chen | |
| 5,876,620 | A * | 3/1999 | Tsai | A47G 19/2288 252/70 |
| 6,050,443 | A * | 4/2000 | Tung | A47G 19/2227 215/12.1 |
| 6,789,393 | B2 * | 9/2004 | Dais | B65D 43/021 62/112 |
| 2010/0147014 | A1 * | 6/2010 | Kim | A47G 19/027 62/457.6 |
| 2011/0155744 | A1 | 6/2011 | Su | |
| 2014/0124470 | A1 * | 5/2014 | Alberts | A47G 19/2288 215/12.1 |

* cited by examiner

*Primary Examiner* — Elizabeth J Martin
(74) *Attorney, Agent, or Firm* — Joseph P. Kincart; Rogers Towers, P.A.

(57) ABSTRACT

A multi-walled glass container is capable of cooling and/or heating contents held within the glass container. More specifically, the multi-walled glass container has at least one fluid-filled freezable and/or heatable pocket, wherein a safety plug may seal a substance within the pocket. The safety plug may contain the substance within the pocket and may release the substance in its original or a different state from the pocket, wherein the release may limit damage to the multi-walled glass container.

6 Claims, 8 Drawing Sheets

MULTI-WALLED GLASS CONTAINER WITH FREEZABLE SUBSTANCE AND SAFETY PLUG

CROSS-REFERENCE TO RELATED APPLICATION

This application claims priority to and the full benefit of U.S. Provisional Patent Application Ser. No. 62/080,388, filed Nov. 16, 2014, and titled "MULTI-WALLED GLASS CONTAINER WITH FREEZABLE SUBSTANCE AND SAFETY PLUG", the entire contents of which are incorporated herein by reference.

BACKGROUND

1. Field of the Disclosure

The present disclosure relates to a multi-walled glass container capable of cooling and/or heating contents held within the glass container. More specifically, the present disclosure presents a multi-walled glass container with at least one fluid-filled freezable and/or heatable pocket, wherein a safety plug may seal the substance within the pocket. The present disclosure further relates to a safety plug that may contain the substance within the pocket and may release the substance in its original or a different state from the pocket, wherein the release may limit damage to the multi-walled glass container.

2. Background of the Disclosure

Serving a cold drink was a luxury first widely proliferated with the advent of refrigeration. Before that, users would have to rely on nature and extremely cold temperatures for ice to cool a beverage. As time went on, users desired portability and an extended period of time for cold beverages. As a result, if a person wanted a cold beverage, they would add ice to a glass. However, this would dilute the beverage as the ice melted. Later, plastic ice cubes filled with freezable substance were developed, but they were inefficient and unsanitary.

More recently, plastic double-walled cups have become a popular option for retaining temperature. Generally, the plastic cups are casual glassware, suitable for outdoor use and boating. As the hollow portion between the two walls is generally hollow, manufacturers often place a decorative sleeve in that hollow portion. For some products, the decorative sleeve may be customizable. Often, the hollow portion is sealed at the lip of the cup by a separate plastic piece. Users would have issues with products not being dishwasher safe, since the pressure from the steam would cause the walls of the product to rupture.

SUMMARY OF THE DISCLOSURE

This sometimes causes discomfort to the user, where the coldness affects their enjoyment of the product, either through being too cold to hold or causing the product contained within to be affected negatively either becoming too cold to drink or turning into a slush-like concoction. Further, sometimes a user would have to wait for the container itself to warm up before being able to be held since it was too cold to touch. The freezing aspect could also hurt the viability and longevity of the product, cracking easily due to the thinness of the product material or as a corollary of the freezing process.

What is needed, therefore, is a safe and efficient way to keep contents cool without dilution. By extension, and for user convenience, a safe and efficient way to keep contents warm or hot without dilution is also needed. A more formal option for cooling or heating glassware, which may broaden the functionality of the glassware is also needed. Accordingly, the present disclosure relates to a multi-walled glass container with a freezable and/or heatable substance and a safety plug.

In contrast to plastic containers, glass containers pose an added safety concern with respect to shattering, wherein the glass shards may be sharp and dangerous. Accordingly, the present disclosure further relates to the safety plug that may contain the freezable and/or heatable substance within the pocket between two adjacent walls.

In some aspects, a multi-walled glass container with safety plug may comprise a glass base comprising a bottom support configured to allow a multi-walled glass container to sit upright when placed on a flat surface; a first glass wall comprising a first topography extending at least partially vertical from the glass base, wherein the first glass wall comprises an interior portion of the multi-walled glass container and wherein the first glass wall is in contact with contents of the multi-walled glass container; a second glass wall comprising a second topography extending at least partially vertical from one or both the glass base or the first glass wall, wherein the first glass wall and the second glass wall form a first pocket; a freezable substance configured to cool the first glass wall, wherein the freezable substance is located within the first pocket; and a safety plug.

In some embodiments, the safety plug may comprise a plugging portion configured to contain the freezable substance within the first pocket, and a release portion in contact with at least part of the plugging portion configured to release at least a portion of the freezable substance in one or more a vapor, liquid, or solid state, wherein a release initiates at a predefined threshold condition within the first pocket, wherein the predefined threshold condition occurs before a damaging condition and wherein the release reduces a chance of one or both damage to or reduction of effectiveness of the multi-walled glass container. In some aspects, the safety plug may be replaceable.

In some implementations, one or more of the first glass wall, the second glass wall, the glass base, or freezable substance may comprise a visible color. In some aspects, the second glass wall may comprise an insulated portion, wherein the insulated portion may be located where a user may grip the multi-walled glass container. In some embodiments, the second topography may comprise a different shape than the first topography.

In some aspects, the multi-walled glass container with safety plug may further comprise a third glass wall comprising a third topography extending at least partially vertical from one or more of the glass base, the first glass wall, or the second glass wall, wherein the second glass wall and the third glass wall form a second pocket. In some embodiments, the safety plug may extend through the third glass wall and wherein the plugging portion limits leaking of the freezable substance from the first pocket to the second pocket.

In some embodiments, the multi-walled glass container with safety plug may further comprise a second safety plug comprising a second plugging portion configured to secondarily contain the freezable substance within the second pocket, and a second release portion in contact with at least part of the second plugging portion configured to release at least a portion of the freezable substance in one or more a vapor, liquid, or solid state, wherein a release from the second release portion initiates at a second predefined threshold condition within the second pocket, and wherein the second predefined condition occurs before a second damaging condition wherein the release reduces the chance of one or both damage to or reduction of effectiveness of the multi-walled glass container.

In some implementations, a safety plug for multi-walled glass container with freezable substance may comprise a plugging portion configured to contain a freezable substance within a pocket comprising two adjacent glass walls of a multi-walled glass container; and a safety mechanism configured to release at least a portion of the freezable substance in one or more vapor, liquid, or solid states from the pocket, wherein the release initiates at a predefined condition within the pocket, wherein the predefined condition occurs before a damaging condition wherein a release reduces a chance of one or both damage to or reduction of effectiveness of the multi-walled glass container.

In some aspects, the safety mechanism may comprise a semi-permeable material capable of containing the freezable substance within the pocket, wherein a change in permeability of the semi-permeable material allows the release; a permeability-changing mechanism in contact with the semi-permeable material, wherein the contact is sufficient to alter the permeability of the semi-permeable material; and an electronic chip in logical communication with the permeability-changing mechanism, wherein the electronic chip is configured to control the permeability-changing mechanism, wherein the control is based on one or more conditions of the pocket.

In some implementations, the safety mechanism may comprise a first material capable of containing the freezable substance within the pocket, wherein a melting or vaporization of the first material allows the release; a melting mechanism in contact with the first material, wherein the contact is sufficient to at least partially melt the first material; and an electronic chip in logical communication with the melting mechanism, wherein the electronic chip is configured to control the melting mechanism, wherein the control is based on one or more conditions of the pocket.

In some aspects, the electronic chip may be configured to detect the one or more conditions of the pocket. In some embodiments, the electronic chip may be configured to monitor the one or more conditions of the pocket. In some implementations, the safety mechanism may comprise a homogenous material, wherein a melting or vaporization point of the homogenous material is similar to a threshold temperature condition of the pocket.

In some embodiments, the safety mechanism may comprise a plurality of materials, wherein each of the plurality of materials comprises a different chemical profile and each of the different chemical profiles comprise a one or both different melting point and different vaporization point. In some aspects, each of the plurality of materials may comprise concentric cylinders that extend from inside the pocket to outside the pocket. In some aspects, each of the plurality of materials comprise cylinders dispersed within the safety mechanism, wherein the cylinders extend from inside the pocket to outside the pocket.

In some implementations, a multi-walled glass container with safety plug may comprise a glass base comprising a bottom support configured to allow a multi-walled glass container to sit upright when placed on a flat surface; a first glass wall comprising a first topography extending at least partially vertical from the glass base, wherein the first glass wall comprises an interior portion of the multi-walled glass container and wherein the first glass wall is in contact with contents of the multi-walled glass container; a second glass wall comprising a second topography extending at least partially vertical from one or both the glass base or the first glass wall, wherein the first glass wall and the second glass wall form a pocket; a substance configured to do one or both cool or heat the first glass wall, wherein the substance is located within the pocket; and a safety plug.

In some aspects, the safety plug may comprise a plugging portion configured to contain the substance within the pocket, and a release portion in contact with at least part of the plugging portion configured to release at least a portion of the substance in one or more a vapor, liquid, or solid state, wherein a release initiates at a predefined threshold condition within the pocket, wherein the predefined threshold condition occurs before a damaging condition and wherein the release reduces a chance of one or both damage to or reduction of effectiveness of the multi-walled glass container.

In some embodiments, at least a portion of the substance may comprise a solid at room temperature configured to melt at a threshold temperature. In some aspects, the substance may comprise a mixture of a solid at room temperature configured to melt at a threshold melting temperature and a liquid configured to freeze at a threshold freezing temperature.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

Figure 1:
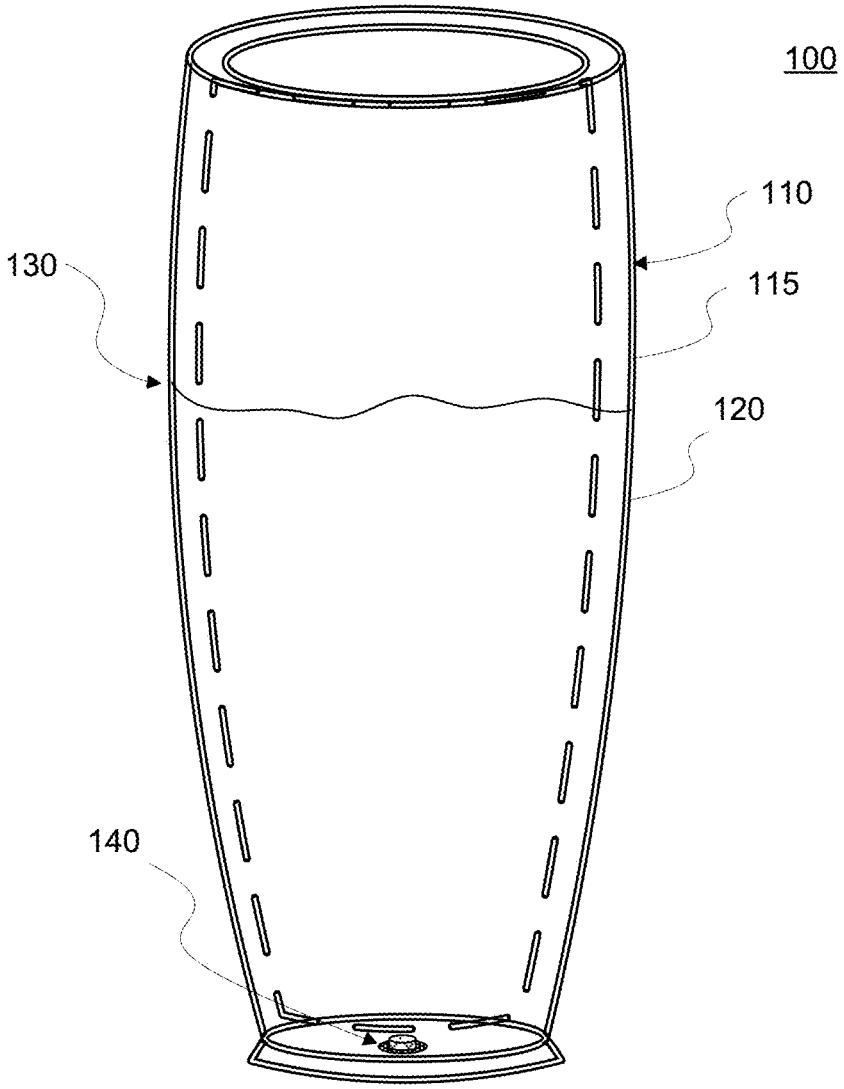
FIG. 1 illustrates an exemplary embodiment of a double-walled glass container with freezable and/or heatable substance and safety plug.

The present disclosure provides generally for multi-walled glass container. According to the present disclosure, a multi-walled glass container may comprise two or more glass walls, wherein adjacent glass walls may form pockets. In some aspects, freezable and/or heatable substance may be located in at least one pocket, and a safety plug may contain the freezable and/or heatable substance within the pocket.

In the following sections, detailed descriptions of examples and methods of the disclosure will be given. The description of both preferred and alternative examples, though throrough, are demonstrative only, and it is understood that to those skilled in the art variations, modifications, and alterations may be apparent. It is therefore to be understood that the examples do not limit the broadness of the aspects of the underlying disclosure as defined by the claims.

GLOSSARY

Multi-walled glass container: as used herein refers to a cooling container comprising at least two adjacent glass walls, wherein adjacent glass walls may form a pocket, and wherein a freezable substance may be stored. In some aspects, an outer glass wall may also form the stabilizing base for the multi-walled glass container; in some embodiments, a separate base may be attached to one or more glass wall. The multi-walled glass container may comprise glass or a glass/polymer mix, which may add a level of shatter resistance, for example.

Freezable substance: as used herein refers to a substance that may be frozen, wherein the frozen substance may retain the cold temperature and cool proximate materials, such as a glass wall or contents of the multi-walled container. In some embodiments, the freezable substance may comprise a mixture, wherein the components may maintain individual properties. In some aspects, the freezable substance may comprise a solution. In some aspects, the term freezable substance refers to a substance that may maintain a threshold cooling temperature, which may not require a technical freezing of the freezable substance.

Heatable substance: as used herein refers to a substance that may be heated, wherein the heated substance may retain the hot temperature and heat proximate materials, such as a glass wall or contents of the multi-walled container. In some embodiments, the heatable substance may comprise a mixture, wherein the components may maintain individual properties. In some aspects, the heatable substance may comprise a solution. In some embodiments, a substance may be both heatable and freezable. For example, a substance may comprise a mixture wherein a freezable portion freezes at a predefined temperature and a heatable portion retains heat at a predefined temperature, wherein one portion may not prohibit the effectiveness of the opposing portion.

Pocket: as used herein refers to a space formed by two adjacent glass walls of a multi-walled glass container. In some embodiments, a fillable pocket may comprise an aperture that may allow contents to be added or released from a pocket. An empty pocket may be sealed without an aperture. In some embodiments, contents of a pocket may be contained by a safety plug, which may plug the aperture.

Safety plug: as used herein refers to a plug that may contain a freezable and/or heatable substance within a pocket of a multi-walled glass container and that may release at least a portion of the freezable and/or heatable substance when a predefined pocket condition occurs, such as a temperature or pressure level.

Referring now to FIG. 1, an exemplary embodiment of a double-walled glass container 100 with freezable and/or heatable substance 130 is illustrated. In some embodiments, a double-walled glass container 100 may comprise an outer glass wall 110 and a complementary interior glass wall 120, wherein the outer glass wall 110 comprises a similar topography to the complementary interior glass wall 120. In some aspects, the outer glass wall 110 and the complementary interior glass wall 120 may form a pocket 115 that may hold the freezable and/or heatable substance 130. The double-walled glass container 100 may further comprise a safety plug 140, which may contain the freezable and/or heatable substance 130 within the pocket 115. In some embodiments, a handle or other separate glass piece may be added (not pictured) to the container or fixture, wherein the handle or separate glass piece may allow for comfortable holding of the double-walled glass. In some aspects, the separate glass piece may insulate a user's hand from direct contact with the outer glass wall 110.

In some implementations, the freezable and/or heatable substance may comprise an evolving mixture, wherein the evolving may occur based on the conditions within the pocket 115, such as pressure or temperature. For example, as temperature increases, components may mix or separate to have a higher vapor point, which may provide an added level of safety in conjunction with the safety plug. As another example, as temperature decreases, components may mix or separate to optimally freeze, wherein the optimal composition may retain cold more effectively, extending the cooling period.

In some embodiments, one or more of the glass walls may comprise a lining, additive, or coating, which may increase effectiveness and/or safety of the multi-walled glass container. In some aspects, an additive such as a polymer may prevent or limit shattering. In some embodiments, a lining may affect a temperature of the multi-walled glass container, such as the exterior portion, interior portion, or pocket.

Figure 7A:
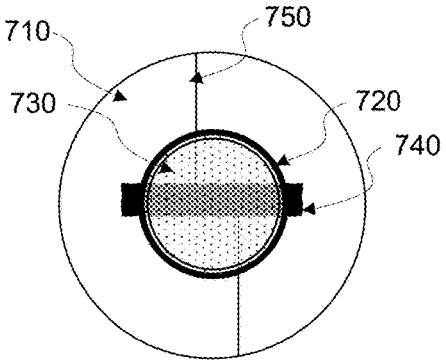
FIG. 7A illustrates an alternate exemplary safety plug for a multi-walled glass container with a freezable and/or heatable substance in top down view.
Figure 7B:
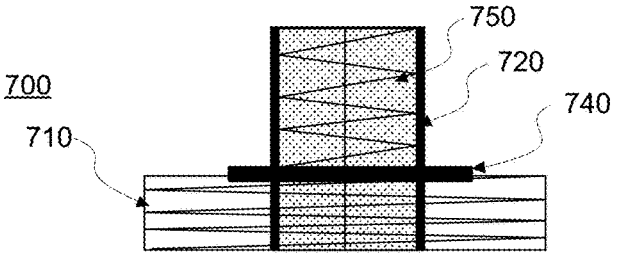
FIG. 7B illustrates an alternate exemplary safety plug for a multi-walled glass container with a freezable and/or heatable substance in cross section.

In some embodiments, a lining or coating within a pocket may directly interact with a "smart" safety plug, such as illustrated and described in FIGS. 7A and 7B. For example, the lining may provide scattered temperature data from within the pocket, which may allow for more accurate monitoring of the pocket conditions. As another example, the safety plug may control an aspect of the lining and may actively change the pocket conditions to fall within the predefined safety parameters.

Figure 2:
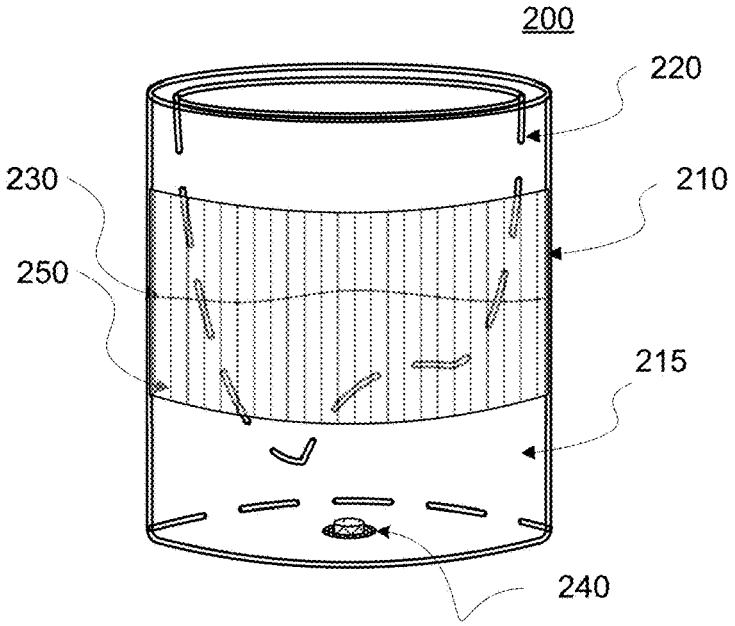
FIG. 2 illustrates an alternate exemplary embodiment of a double-walled glass container with freezable and/or heatable substance and safety plug.

Referring now to FIG. 2, an alternate exemplary embodiment of a double-walled glass container 200 with freezable and/or heatable substance 230 is illustrated. In some embodiments, the double-walled glass container 200 may comprise an outer glass wall 210 and an interior glass wall 220, wherein the interior glass wall 220 may comprise a topography distinct from the outer glass wall 210. In some embodiments, the interior glass wall 220 may be altered for aesthetic reasons, such as holiday themes, branding, or artistic design. In some aspects, the interior glass wall 220 may be customizable based on user preference.

In some aspects, the outer glass wall 210 and the interior glass wall 220 may form a pocket 215 that may hold the freezable and/or heatable substance 230. The double-walled glass container 200 may further comprise a safety plug 240, which may contain the freezable and/or heatable substance 230 within the pocket 215. In some implementations, the outer glass wall 210 may be uncomfortably cold or hot to the touch, and the double-walled glass container may comprise a cold-resistant and/or heat-resistant portion or insulation portion 250, which may maintain a comfortable temperature to the touch. The cold resistant portion 250 may reduce the heat transferred from a user's hand to the pocket 215, which may allow the freezable substance 230 to maintain a frozen or cold state longer. In some aspects, the cold-resistant portion 250 may be a visible layer on the exterior of the outer glass wall 210. In some implementations, the cold-resistant portion 250 may be integrated into the outer glass wall 210. In some aspects, the heat resistant portion 250 may reduce the heat from the outer glass wall 210 to increase comfort for user handling.

Figure 3:
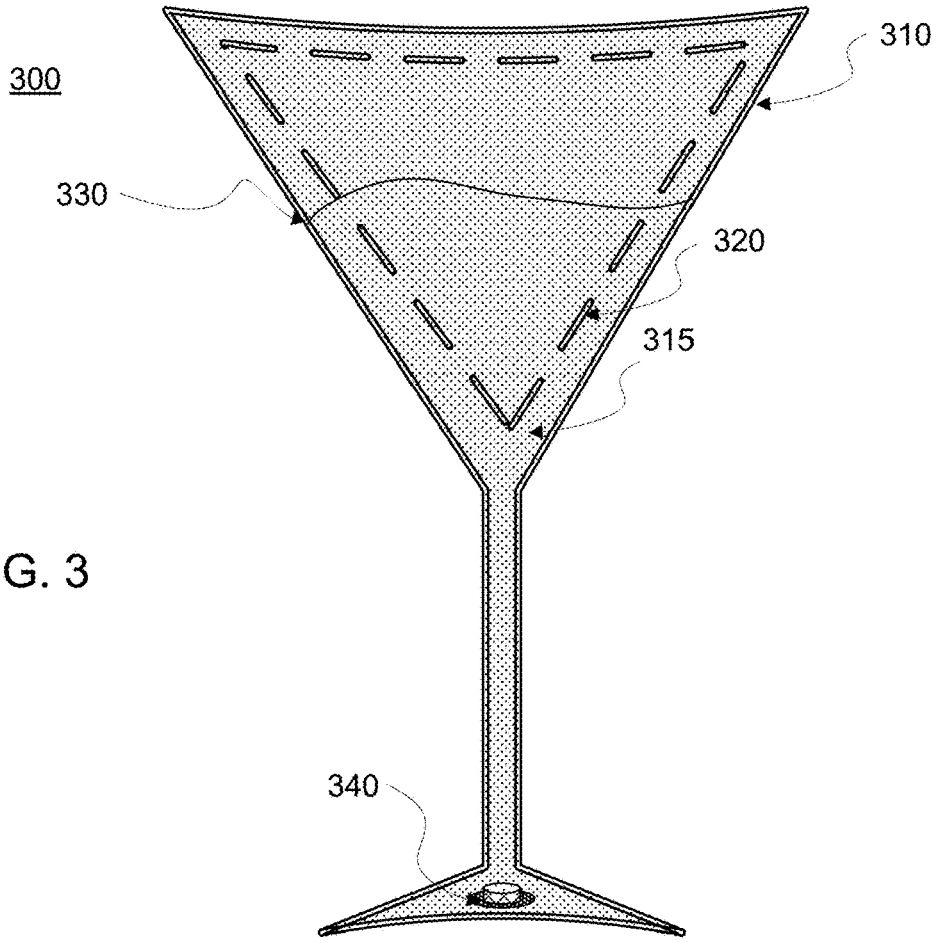
FIG. 3 illustrates an alternate exemplary embodiment of a double-walled glass container with freezable and/or heatable substance and safety plug.

Referring now to FIG. 3, an alternate exemplary embodiment of a double-walled glass container 300 with freezable and/or heatable substance 330 is illustrated, wherein the double-walled glass container may comprise a martini glass shape. In some embodiments, the double-walled glass container 300 may comprise a stem, wherein the outer glass wall 310 may form the stem. In some aspects, the freezable and/or heatable substance 330 may be contained within a pocket 315, which may be formed by the outer glass wall 310 and an interior glass wall 320, wherein the freezable and/or heatable substance 330 may fill the stem. The double-walled glass container 300 may further comprise a safety plug 340, which may contain the freezable and/or heatable substance 330 within the pocket 315. In some embodiments, the stem may comprise a separate glass piece, which may be solid or hollow, wherein the freezable and/or heatable substance 330 may not fill the stem.

Where the stem and base may not contain the freezable and/or heatable substance 330, a safety plug 340 may be placed in a location that allows the safety plug 340 to hold the freezable and/or heatable substance 330 in the pocket 315, for example, on the outside of the double-walled glass container 300. In some aspects, the safety plug 340 may be triggered when the double-walled glass container 300 holds a liquid. Accordingly, the safety plug 340 may not be as effective in an interior position, wherein the release of liquid or vapor may be released into the liquid, which may cause splattering and spillage.

In some embodiments, the outer glass wall 310 may comprise a color or tint. For example, the outer glass wall 310 may comprise a tinted glass. In some embodiments, the outer glass wall 310 may be painted or coated with a colored substance. In some aspects, the coloration may be customizable, and the outer glass wall 310 may comprise a decorative pattern or image. In some aspects, one or both the interior glass wall 320 or the outer glass wall 310 may comprise a textured or etched surface, which may add aesthetic value and/or may add functionality. For example, a textured surface on the outer glass wall 310 may reduce slippage when gripping the double-walled glass container 300. Similarly, a textured surface on the outer glass wall 310 may allow for insulation of the freezable and/or heatable substance 330, which may allow for comfortable gripping of the frozen or heated glass and extend the frozen or heated length by limiting the transfer of heat or cold from a user's hand to the pocket 315. In some aspects, a handle (not shown) may extend from the outer glass wall 310 or some other portion to further reduce a user's hand from being exposed to the elements. This handle may also feature a textured surface as previously described to reduce slippage when gripping the handle and for insulation from the freezable and/or heatable substance 330.

In some aspects, the thickness of one or more of the glass walls may be varied, wherein the variation may add functionality. For example, the thickness may be varied to strengthen particular locations, such as around the aperture of the pocket or the lip or base of the multi-walled glass container. As another example, the varied thickness may determine breaking points, which may allow for a safer break if the multi-walled glass container is dropped or breaks. A liner along the breaking points may create a dull edge, which may reduce injury caused by sharp edges of broken glass.

Figure 4A:
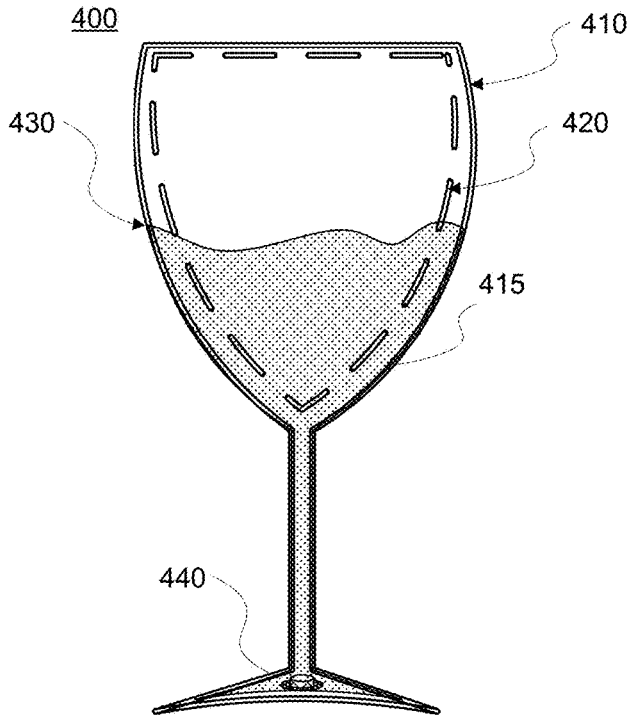
FIG. 4A illustrates an alternate exemplary embodiment of a double-walled glass container with freezable and/or heatable substance and safety plug.

Referring now to FIG. 4A, an alternate exemplary embodiment of a double-walled glass container 400 with freezable substance 430 is illustrated, wherein the freezable and/or heatable substance 430 is in a liquid state, such as at room temperature. In some embodiments, the double-walled glass container 400 may comprise an outer glass wall 410 and interior glass wall 420, wherein the outer glass wall 410 and the interior glass wall 420 may form a pocket 415, which may contain the freezable and/or heatable substance 430. The double-walled glass container 400 may further comprise a safety plug 440, which may contain the freezable and/or heatable substance 430 within the pocket 415.

Figure 4B:
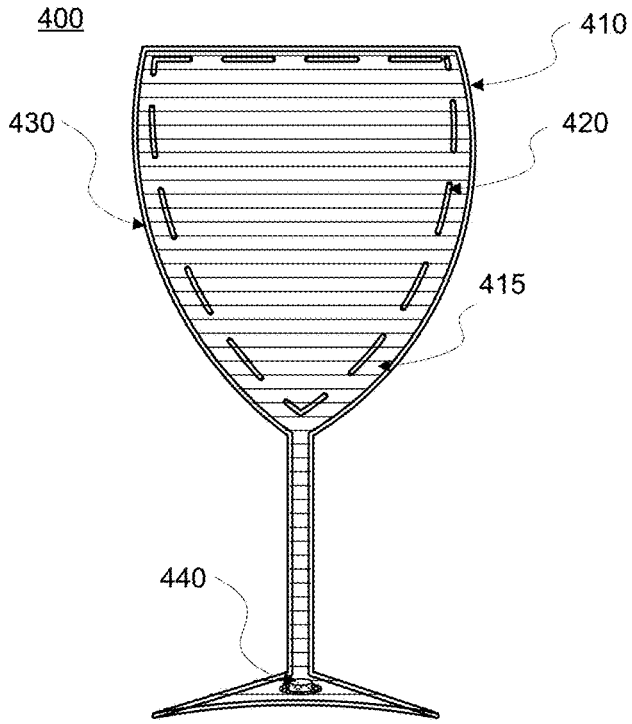
FIG. 4B illustrates an alternate exemplary embodiment of a double-walled glass container with freezable and/or heatable substance and safety plug.

Referring now to FIG. 4B, the alternate exemplary embodiment of a double-walled glass container 400 with freezable substance 430 of FIG. 4A is illustrated, wherein the freezable substance 430 is in a frozen state. In some embodiments, the freezable and/or heatable substance 430 may comprise a color-changing composition, wherein at least one component of the freezable and/or heatable substance 430 mixture may change color based on an environmental characteristic, such as temperature, exposure to UV light, or pressure within the pocket 415.

Figure 5C:
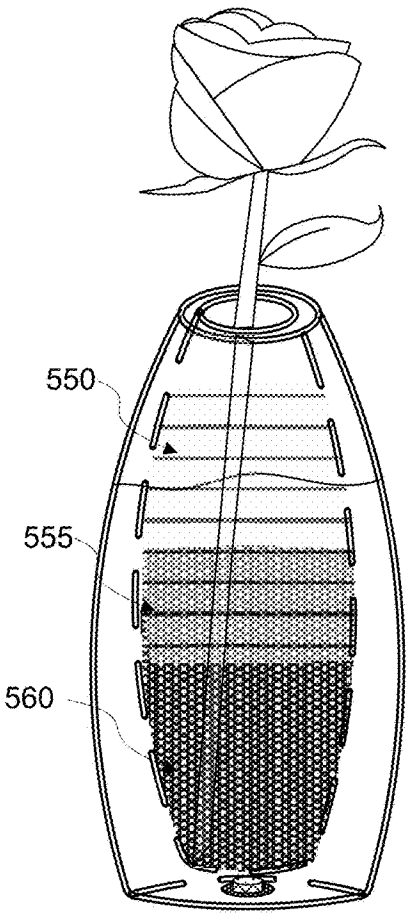
FIG. 5C illustrates an alternate exemplary embodiment of a double-walled glass container with freezable and/or heatable substance and safety plug.
Figure 5B:
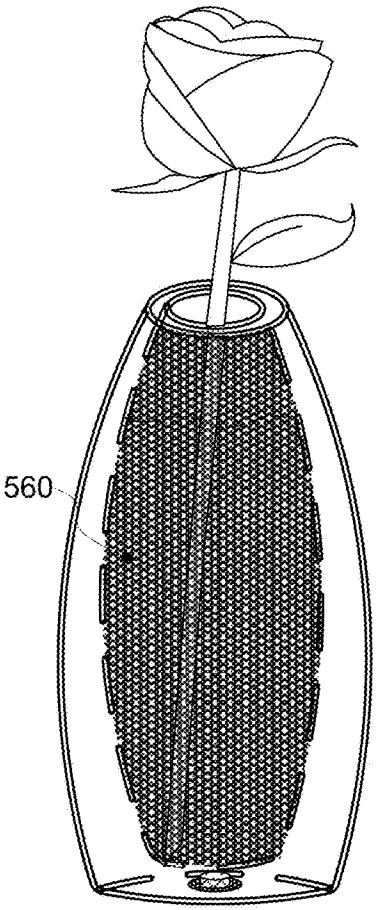
FIG. 5B illustrates an alternate exemplary embodiment of a double-walled glass container with freezable and/or heatable substance and safety plug.
Figure 5A:
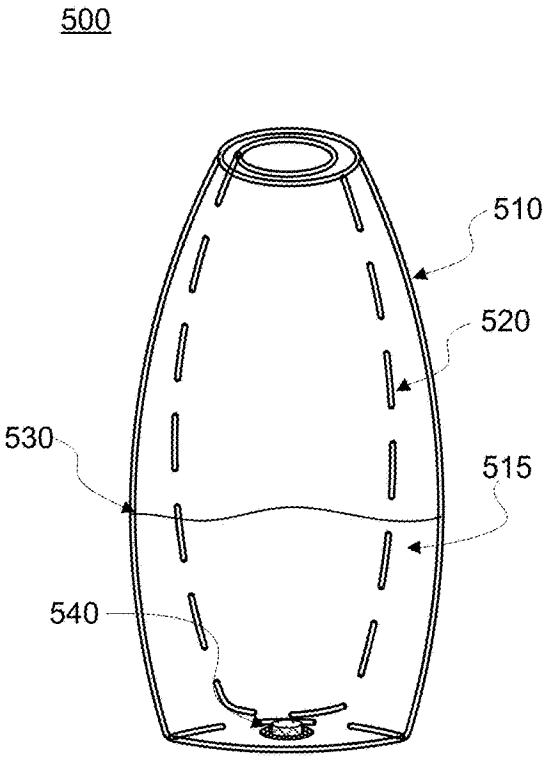
FIG. 5A illustrates an alternate exemplary embodiment of a double-walled glass container with freezable and/or heatable substance and safety plug.

Referring now to FIG. 5A, an alternate exemplary embodiment of a double-walled glass container 500 with freezable substance 530 is illustrated, wherein the freezable and/or heatable substance 530 is in a liquid state, such as at room temperature. In some embodiments, the double-walled glass container 500 may comprise an outer glass wall 510 and interior glass wall 520, wherein the outer glass wall 510 and the interior glass wall 520 may form a pocket 515, which may contain the freezable and/or heatable substance 530. The double-walled glass container 500 may further comprise a safety plug 540, which may contain the freezable and/or heatable substance 530 within the pocket 515.

In some embodiments, the interior glass wall 520 may comprise a color-changing additive, wherein the color may change based on an environmental characteristic, such as temperature or exposure to light. The interior glass wall 520 may be clear when the double-walled glass container 500 is at room temperature. In some embodiments, the double-walled glass container 500 may comprise a vase designed to extend the life of certain flora that may thrive in cold water, such as cut flowers, like roses or bulb flowers.

Referring now to FIG. 5B, the alternate exemplary embodiment of a double-walled glass container 500 with freezable substance 530 of FIG. 5A is illustrated, wherein the freezable substance 530 is in a frozen state. In some embodiments, the interior glass wall 520 may turn a frozen color 560 when the freezable substance 530 is in a frozen state.

Referring now to FIG. 5C, the alternate exemplary embodiment of a double-walled glass container 500 with freezable and/or heatable substance 530 of FIG. 5A is illustrated, wherein the freezable and/or heatable substance 530 is in a mixed liquid/solid state, such as during the freezing or melting process. In some embodiments, the interior glass wall 520 may change color from the frozen or heated color 560 as the freezable and/or heatable substance 530 thaws or heats up. For example, as the double-walled glass container 500 warms, the interior glass wall 520 may comprise multiple colors 550, 555, 560 as it transitions.

Figure 6A:
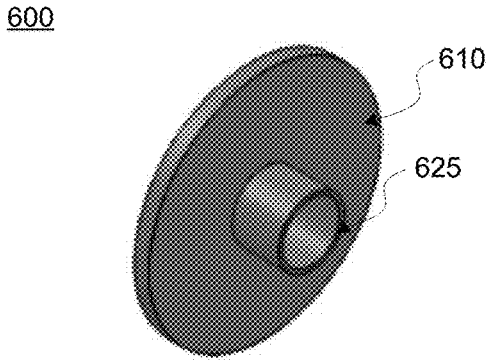
FIG. 6A illustrates an exemplary safety plug for a multi-walled glass container with a freezable and/or heatable substance in perspective view.

Referring now to FIG. 6A, an exemplary embodiment of a safety plug 600 for a multi-walled glass container is illustrated in a perspective view. In some embodiments, the safety plug 600 may comprise a plugging mechanism 610 that may house a safety mechanism that may be located in a housing portion 625 of the safety plug 600.

Figure 6B:
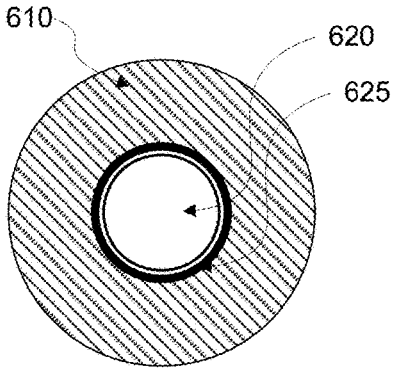
FIG. 6B illustrates an exemplary safety plug for a multi-walled glass container with a freezable and/or heatable substance in top down view.

Referring now to FIG. 6B, an exemplary embodiment of a safety plug 600 for a multi-walled glass container is illustrated in a top down view. In some embodiments, the safety mechanism 620 may comprise a material that may melt at a predetermined temperature, wherein the melting may create an exit path for air or the freezable and/or heatable substance in one or more states. The exit path may allow a release of pressure to limit the chance of shattering, breaking, or cracking the multi-walled glass container.

Figure 6C:
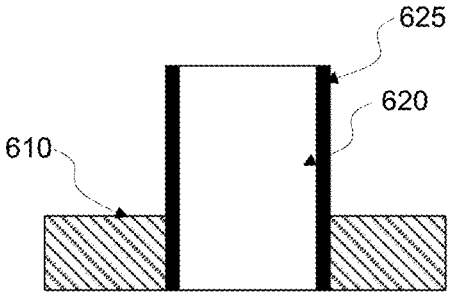
FIG. 6C illustrates an exemplary safety plug for a multi-walled glass container with a freezable and/or heatable substance in cross section.

Referring now to FIG. 6C, an exemplary embodiment of a safety plug 600 for a multi-walled glass container is illustrated in a cross section view. In some embodiments, the safety mechanism 620 may extend from a pocket with freezable and/or heatable substance, such as described and illustrated in FIGS. 1-3, to the bottom of the multi-walled glass container. In some aspects, the safety mechanism 620 may create an open channel, wherein the freezable and/or heatable substance may be released under predefined emergency conditions, for example high heat.

As an illustrative example, at high temperatures, one or more components in the freezable and/or heatable substance may transition into a vapor state. The vapor state may cause an increase of pressure within the pocket, which may cause the multi-walled glass container to crack, break, or shatter. The safety mechanism 620 may be triggered at a specific threshold pressure or temperature. In some embodiments, the open channel may increase in size with an increase in pressure and/or temperature, wherein the size of the open channel may be directly related to the potential speed of release of the vapor and/or liquid. For example, initially, the open channel may be small and allow vapor to release slowly, which may be sufficient to prevent breaking. As the temperature and/or pressure increase past the threshold, the larger open channel may allow vapor to release at a faster speed, and a still larger open channel may allow liquid to release. The same example would apply were a heatable substance to be involved.

The changing open channel size may allow the safety mechanism 620 to be effective with the least amount of leakage. For example, a slight release of vapor may be sufficient to avoid cracking the multi-walled glass container, and the open channel may remain small enough to prevent the release of liquid or solid, wherein the pocket may retain the ability to hold the freezable and/or heatable substance in liquid and/or solid state.

In some embodiments, one or more the safety plug 600, plugging mechanism 610, or safety mechanism 620 may be replaceable. In some embodiments, the safety plug 600 may be upgradable, such as to the "smart" safety plug described in FIGS. 7A-7B. Where at least a portion of the safety plug 600 may be replaceable, the freezable and/or heatable substance may be replaceable. In some such embodiments, the replaced freezable and/or heatable substance may be customizable, such as by color, temperature retention ability, or other aspects. In some embodiments, the substance may be replaced by either a freezable or heatable substance.

Referring now to FIG. 7A, an alternate exemplary embodiment of a safety plug 700 for a multi-walled glass container is illustrated in a top down view. In some embodiments, the safety mechanism 720 may comprise an electronic chip 740, which may heat a melting mechanism 750. In some aspects, the melting mechanism 750 may comprise heat absorbing wires coiled throughout one or both the plugging mechanism 710 and the safety mechanism 720. The electronic chip 740 may be integrated into any safety plug, such as those described in FIGS. 6A-10B, wherein the integration may elevate a passive safety plug to a "smart" safety plug.

Referring now to FIG. 7B, an alternate exemplary embodiment of a safety plug 700 for a multi-walled glass container is illustrated in a cross section view. In some embodiments, the electronic chip 740 may be embedded on the surface of the plugging mechanism 710, wherein the electronic chip 740 may be in direct contact with the pocket with freezable substance. Direct exposure to the conditions of the pocket may allow for a more accurate monitoring and accordingly, a more effective safety response.

In some aspects, at a predefined threshold temperature and/or pressure, the electronic chip 740 may activate the safety mechanism 720. In some embodiments, the activation may cause the melting mechanism 750 to change the state of at least one component of the safety mechanism 720. For example, the melting mechanism 750 may change a predefined component of the safety mechanism 720 into a vapor state, wherein the change may allow a vapor of the freezable substance to release from the pocket. In some aspects, once the pocket is stabilized and the danger of shattering is diminished, the electronic chip 740 may deactivate the melting mechanism 750, which may allow the predefined component of the safety mechanism 720 to return to its original state. Such an embodiment may allow the safety plug 700 to be activated multiple times without complete loss of effectiveness.

In some aspects, the number of times the safety plug 700 may be activated may be limited by the amount of freezable or heatable substance lost in each safety release. In some embodiments, the electronic chip 740 may be able to assess the composition of the freezable or heatable substance, wherein the assessing may allow the electronic chip 740 to monitor the levels of releasable freezable or heatable substance and/or the remaining safety activations. For example, the electronic chip 740 may work in conjunction with an indicator to notify a user that the safety plug 700 has been activated and/or what percentage of the original releasable freezable or heatable substance may remain in the pocket. This may allow a user to purchase additional multi-walled glass containers, safety plugs 700, and/or freezable substance and/or heatable substance prior to complete loss of effectiveness.

In some embodiments, the safety mechanism 720 may allow predefined vapor or liquid components to be introduced back in to the pocket, wherein the introduced components may mix or react with the freezable or heatable substance, which may extend the use of the multi-walled glass container, even after a safety release. In some embodiments, the electronic chip 740 may recognize the type and amount of the lost component, and may trigger a change in the safety mechanism 720 that may allow for a selective permeability of predefined components. For example, the safety mechanism 720 may allow one or more component of ambient air to permeate into the pocket and block the escape of those components from the pocket. As another example, a user may be prompted to perform a specific action, such as run water over the safety plug 700, drip a predefined liquid over the safety plug 700, or place a predefined tab or sticker over the safety plug 700. In some aspects, the predefined liquid, tab, or sticker may comprise a predefined formulation that may permeate, at least in part, through the safety plug in an inactive or activated state, wherein the permeation may increase the length of use for the freezable substance.

In some embodiments, the electronic chip 740 may operate on low power, wherein the electronic chip 740 may comprise a power source. In some aspects, the power source may be rechargeable, such as by exposure to light or heat.

In some embodiments, the container may be paired with an inductive base, charger, dock, pedestal, or coaster that may be powered via a cable, universal serial bus (USB), battery, or some other means. In some embodiments, this inductive base may communicate or be paired with the electronic chip to facilitate the functionality described above, programmable or accessible by the user physically or by other means, such as electronically. Aside from this functionality, the inductive base may also warm, heat, cool, or freeze the contents of the container when placed upon the base. The base itself could be transportable and carried into other rooms as the user requires it. A built-in safety mechanism could be built in to the programming to control the maximum temperature while also separately establishing a cut-off time for said functionality. For example, if a user unplugs the base to bring it into another room and uses the base as a coaster to keep a drink warm, the heating functionality could turn off automatically after a pre-set time for safety purposes. Some examples of this base functionality would be to prolong the life of a vase of flowers or to cool or warm a drink. In some embodiments, this base may have mesh wiring built into the base to facilitate heating or cooling and may comprise heat absorbing wires coiled throughout the base.

Figure 8A:
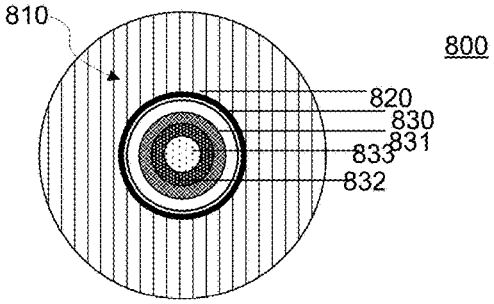
FIG. 8A illustrates an alternate exemplary safety plug for a multi-walled glass container with a freezable and/or heatable substance in top down view.

Referring now to FIG. 8A, an alternate exemplary embodiment of a safety plug 800 for a multi-walled glass container is illustrated in a top down view. In some embodiments, the safety plug 800 may comprise a plugging mechanism 810 that may contain the freezable substance within the pocket and a safety mechanism 820 that may release the freezable substance in a liquid, vapor, or solid state to prevent shattering, breaking, constricting, or cracking of the multi-walled glass container. In some aspects, the safety mechanism 820 may comprise concentric cylinders 830-833 of material, wherein each concentric cylinder 830-833 may activate at different pocket conditions, such as temperature and/or pressure.

In some embodiments, the safety plug 800 may comprise a plugging mechanism 810 that may contain a heatable substance within the pocket and a safety mechanism 820 that may release the heatable substance in a liquid, vapor, or solid state to prevent shattering, breaking, expansion, or cracking of the multi-walled glass container. In some embodiments, the safety plug 800 may comprise a plugging mechanism 810 that may contain both a heatable and freezable substance within the pocket that may be released according the user, either through physical manipulation, programming, electronically, or some other means. Depending on the substance chosen, a safety mechanism 820 may release the substance in a liquid, vapor, or solid state to prevent shattering, breaking, constricting, expansion, or cracking of the multi-walled glass container.

In some aspects, the substance contained within the pocket may comprise a mixture, wherein a portion of the mixture comprises a heatable substance and a portion comprises a freezable portion. In some embodiments, the substance may comprise a solid, liquid, or mixture of both. For example, a heatable portion of the substance may comprise a solid that may melt at a predefined threshold temperature, and a freezable portion of the substance may comprise a liquid that may freeze at a predefined threshold temperature. As another example, the substance may comprise a solid that may be heatable and freezable, wherein the solid may melt at a threshold temperature to heat and may retain cold at a threshold temperature to cool.

Figure 8B:
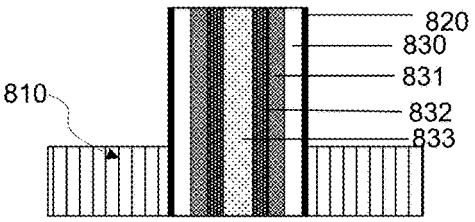
FIG. 8B illustrates an alternate exemplary safety plug for a multi-walled glass container with a freezable and/or heatable substance in cross section.

Referring now to FIG. 8B, an alternate exemplary embodiment of a safety plug 800 for a multi-walled glass container is illustrated in a cross section view.

Figure 9A:
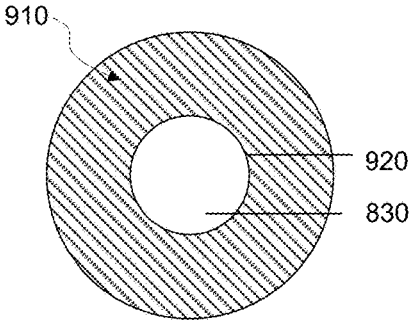
FIG. 9A illustrates an alternate exemplary safety plug for a multi-walled glass container with a freezable and/or heatable substance in top down view.
Figure 9B:
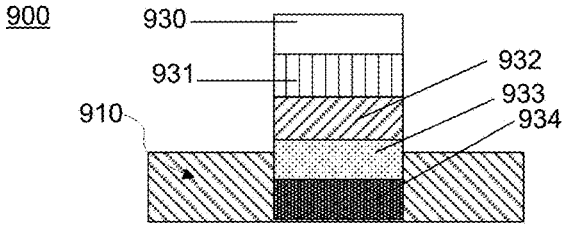
FIG. 9B illustrates an alternate exemplary safety plug for a multi-walled glass container with a freezable and/or heatable substance in cross section.

Referring now to FIG. 9A, an alternate exemplary embodiment of a safety plug 900 for a multi-walled glass container is illustrated in a top down view. Referring now to FIG. 9B, an alternate exemplary embodiment of a safety plug 900 for a multi-walled glass container is illustrated in a cross section view.

In some embodiments, the safety plug 900 may comprise a plugging mechanism 910 that may contain the freezable and/or heatable substance within the pocket and a safety mechanism 920 that may release the freezable and/or heatable substance in a liquid, vapor, or solid state to prevent shattering, breaking, or cracking of the multi-walled glass container. In some implementations, the safety mechanism 920 may comprise multiple layers 930-934 of material, wherein each layer 930-934 may activate at different pocket conditions.

Figure 10A:
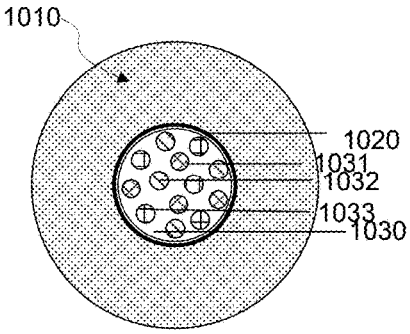
FIG. 10A illustrates an alternate exemplary safety plug for a multi-walled glass container with a freezable and/or heatable substance in top down view.
Figure 10B:
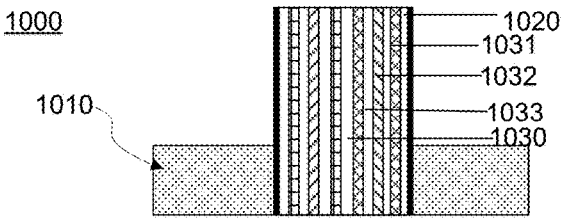
FIG. 10B illustrates an alternate exemplary safety plug for a multi-walled glass container with a freezable and/or heatable substance in cross section.

Referring now to FIG. 10A, an alternate exemplary embodiment of a safety plug 1000 for a multi-walled glass container is illustrated in a top down view. Referring now to FIG. 10B, an alternate exemplary embodiment of a safety plug 1000 for a multi-walled glass container is illustrated in a cross section view.

In some embodiments, the safety plug 1000 may comprise a plugging mechanism 1010 that may contain the freezable substance within the pocket and a safety mechanism 1020 that may release the freezable and/or heatable substance in a liquid, vapor, or solid state to prevent shattering, breaking, or cracking of the multi-walled glass container. In some aspects, the safety mechanism 1020 may comprise smaller cylinders 1031-1033 of different materials distributed throughout a larger cylinder 1030, wherein each cylinder 1030-1033 may activate at different pocket conditions. In some embodiments, the smaller cylinders 1031-1034 may comprise low modulus material and the larger cylinder 1030 may comprise a higher modulus material.

In some embodiments, the safety plug may comprise multiple materials, which may absorb energy at different rates. The variation in absorption rates may allow for a gradual release of pressure from the fluid-filled portion. In some embodiments, a gradual release may allow for a less violent release in pressure, which may allow the safety release to occur with minimal chance for causing damage to surrounding objects. In some embodiments, a gradual release may allow a safety plug to relieve pressure from the fluid-filled portion on multiple occasions. In some aspects, the multiple materials may have different melting points. In some embodiments, the multiple materials may respond to a series of predefined threshold temperatures. In some aspects, the multiple materials may absorb energy at different rates. In some embodiments, the multiple materials may be dispersed in a predefined effective ratio, wherein the ratio may be relative to one or more of the following: each other, the plugged aperture, the volume of liquid, the size of the safety plug compared to the size of the multi-walled glass container.

In some embodiments, a sealant, glue, or lubricant may be added along the contact points between an aperture and a safety plug. In some aspects, a sealant or glue may secure the safety plug and reduce leakage at the contact points. In some implementations, a lubricant may allow for easier insertion of the safety plug into the aperture. In some aspects, the lubricant may be heat activated and may allow for an easier release of the safety plug in an emergency situation.

Figure 11:
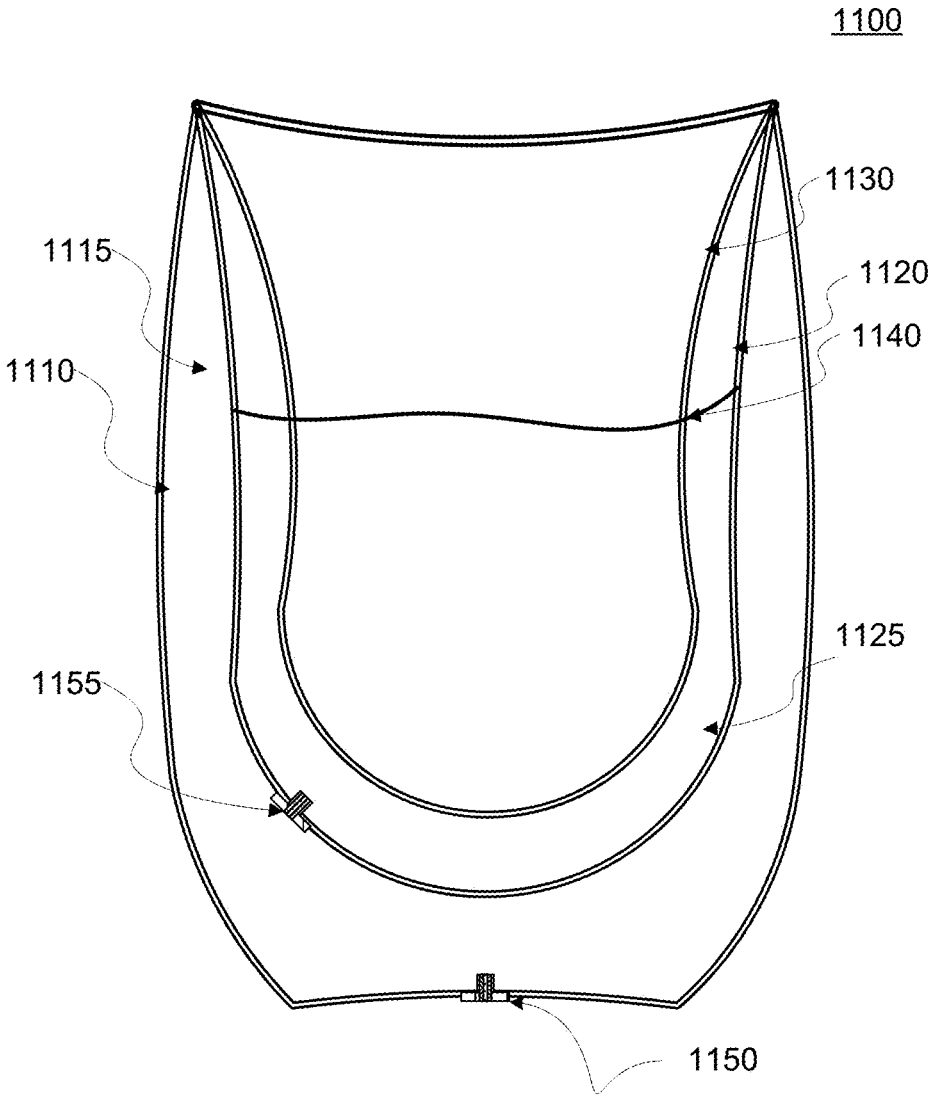
FIG. 11 illustrates an exemplary embodiment of a triple-walled glass container with freezable and/or heatable substance and safety plug.

Referring now to FIG. 11, an exemplary embodiment of a triple-walled glass container 1100 with freezable and/or heatable substance 1140 is illustrated in cross section. In some embodiments, a triple-walled glass container 1100 may comprise an interior glass wall 1130, a middle glass wall 1120, and an outer glass wall 1110, wherein the interior glass wall 1130 and the middle glass wall 1120 may form an inner pocket 1125 and the middle glass wall 1120 and the outer glass wall 1110 may form an outer pocket 1115. In some aspects, the outer pocket 1115 may provide insulation between a user's hand and the inner pocket 1125. In some embodiments, the insulation may allow the user to comfortably hold the triple-walled glass container, even where the freezable and/or heatable substance is frozen, and the insulation may reduce the heat transfer from the user's hand to the inner pocket 1125, which may allow the freezable and/or heatable substance to stay cold longer.

The triple-walled glass container 1100 may further comprise a system of safety plugs 1155, 1150, wherein the system may comprise a first safety plug 1155, which may contain the freezable and/or heatable substance 1140 within the inner pocket 1125, and a second safety plug 1150, which may serve as a secondary release and allow released material to escape. In some embodiments, the safety plugs 1150, 1155 may be configured in a similar manner as those described in FIGS. 6A-10B, wherein the safety plugs 1150, 1155 may comprise the same configuration or different configurations. In some aspects, the two pockets may comprise distinct safety parameters, wherein the first safety plug 1155 may be configured to the safety parameters of the inner pocket 1125, and the second safety plug 1150 may be configured to the safety parameters of the outer pocket 1115.

Figure 12:
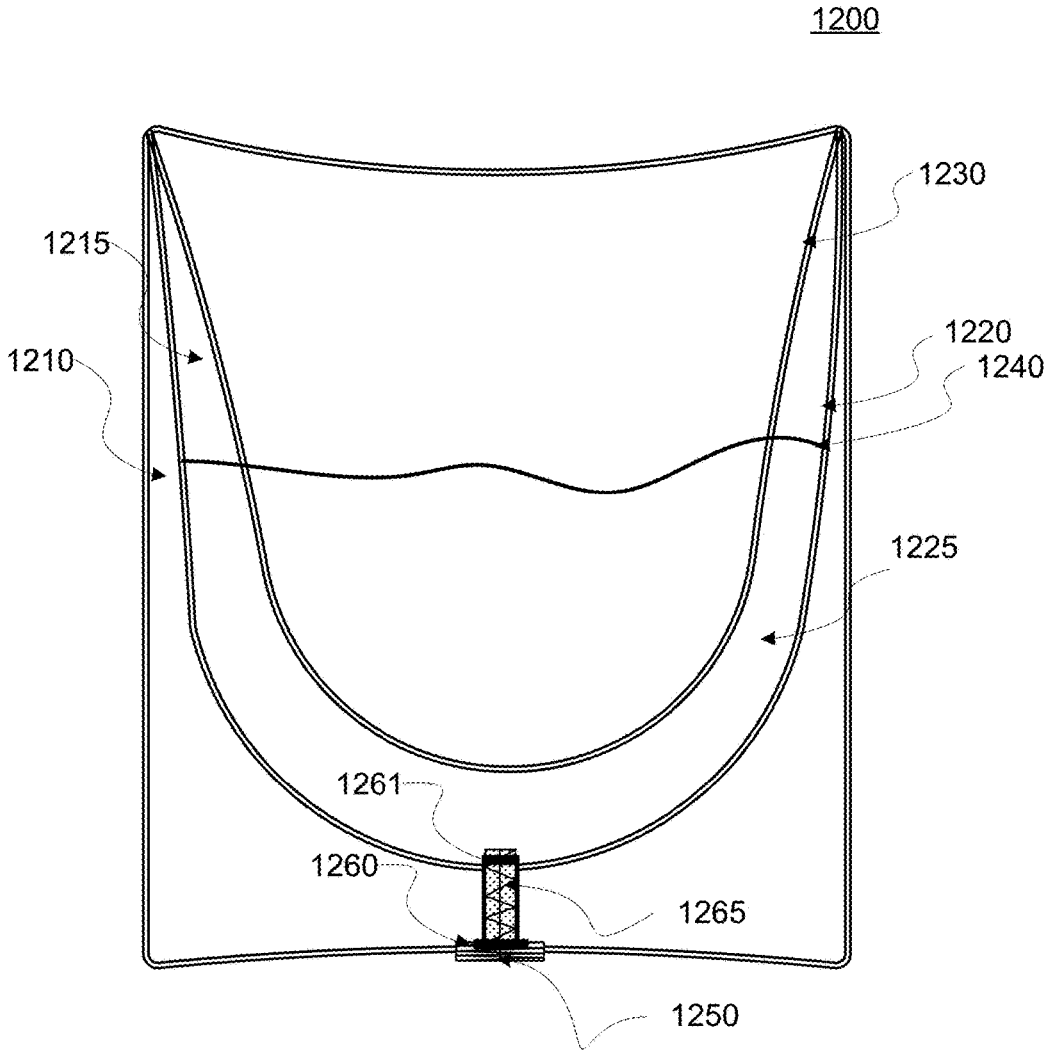
FIG. 12 illustrates an alternate exemplary embodiment of a triple-walled glass container with freezable and/or heatable substance and safety plug.

Referring now to FIG. 12, an exemplary embodiment of a triple-walled glass container 1200 with freezable and/or heatable substance 1240 is illustrated in cross section. In some embodiments, a triple-walled glass container 1200 may comprise an interior glass wall 1230, a middle glass wall 1220, and an outer glass wall 1210, wherein the interior glass wall 1230 and the middle glass wall 1220 may form an inner pocket 1225 and the middle glass wall 1220 and the outer glass wall 1210 may form an outer pocket 1215.

The triple-walled glass container 1200 may further comprise an extended safety plug 1250, which may contain the freezable substance 1240 within the inner pocket 1225. In some embodiments, the extended safety plug 1250 comprise a plugging mechanism that may extend from the outer glass wall 1110 through the middle glass wall 1220. In contrast to the multiple safety plug system illustrated and described in FIG. 11, an extended safety plug 1250 may combine the capabilities of multiple safety plugs into a single extended safety plug 1250. As illustrated, the extended safety plug 1250 may comprise a "smart" safety plug, wherein one or more electric chips may control the activation of the extended safety plug 1250. In some embodiments, the extended safety plug 1250 may comprise multiple electronic chips, which may allow for separate monitoring of the inner pocket 1225 and the outer pocket 1215.

In some embodiments, the freezable substance 1240 may be contained in the outer pocket, wherein an extended safety plug 1250 may not be necessary. In some embodiments, a first freezable and/or heatable substance may be contained within the inner pocket 1225, and a second freezable and/or heatable substance may be contained within the outer pocket 1215, wherein the first freezable and/or heatable substance may or may not comprise the same composition as the second freezable and/or heatable substance.

CONCLUSION

A number of embodiments of the present disclosure have been described. While this specification contains many specific implementation details, there should not be construed as limitations on the scope of any disclosures or of what may be claimed, but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A multi-walled glass container with a safety plug comprising:

a glass base comprising a bottom support configured to allow the multi-walled glass container to sit upright when placed on a flat surface;

a first glass wall comprising a first topography extending at least partially vertical from the glass base, wherein the first glass wall comprises an interior portion of the multiwalled glass container and wherein the first glass wall is in contact with contents of the multiwalled glass container;

a second glass wall comprising a second topography extending at least partially vertical from one or both the glass base or the first glass wall, wherein the first glass wall and the second glass wall form a first pocket;

a freezable substance configured to cool the first glass wall, wherein the freezable substance is located within the first pocket, and wherein at least one component of the freezable substance changes color based on a temperature of the freezable substance thereby providing a visual indication of an environmental condition; and the safety plug comprising:

a plugging portion configured to contain the freezable substance within the first pocket, and a release portion comprising a safety mechanism located in a housing portion of the safety plug, safety, the release portion in contact with at least part of the plugging portion configured to release at least a portion of the freezable substance in one or more a vapor, liquid, or solid state, wherein a release initiates at a predefined threshold pressure within the first pocket as determined by the safety mechanism, wherein the predefined threshold pressure occurs before a damaging to the multi-walled glass container.

2. The multi-walled glass container with safety plug of claim 1, wherein the plugging portion comprises a channel with an opening that increases based upon an increase in pressure against the plugging portion.

3. The multi-walled glass container with safety plug of claim 1, wherein the second glass wall comprises an insulated portion, wherein the insulated portion is located where a user grips the multi-walled glass container.

4. The multi-walled glass container with safety plug of claim 1, wherein the safety plug is replaceable.

5. The multi-walled glass container with safety plug of claim 1, wherein the safety mechanism comprises a material set to melt at a predetermined temperature and said melt creates an exit path for the freezable substance.

6. The multi-walled glass container with safety plug of claim 5, wherein the exit path increases in size with an in temperature and the safety plug limits leaking of the freezable substance from the first pocket.

* * * * *